US009795201B2

(12) United States Patent
Barraclough et al.

(10) Patent No.: US 9,795,201 B2
(45) Date of Patent: Oct. 24, 2017

(54) DEVICE AND METHOD

(75) Inventors: Andrew Barraclough, Slough (GB); Michael Wu, GuangZhou (CN); Carl Dibnah, Hull (GB)

(73) Assignee: RECKITT BENCKISER (UK) LIMITED, Slough (GB)

( * ) Notice: Subject to any disclaimer, the term of this patent is extended or adjusted under 35 U.S.C. 154(b) by 1180 days.

(21) Appl. No.: 11/547,580

(22) PCT Filed: Apr. 6, 2005

(86) PCT No.: PCT/GB2005/001335

§ 371 (c)(1),
(2), (4) Date: Oct. 3, 2006

(87) PCT Pub. No.: WO2005/096879

PCT Pub. Date: Oct. 20, 2005

(65) Prior Publication Data

US 2007/0208354 A1 Sep. 6, 2007

(30) Foreign Application Priority Data

Apr. 8, 2004 (GB) ..... 0407965.3
Jun. 18, 2004 (GB) ..... 0413670.1

(51) Int. Cl.

| | |
|---|---|
| ***A61B 17/50*** | (2006.01) |
| ***A45D 27/44*** | (2006.01) |
| ***A45D 26/00*** | (2006.01) |
| *A45D 34/04* | (2006.01) |

(52) U.S. Cl.
CPC ..... *A45D 27/44* (2013.01); *A45D 26/00* (2013.01); *A45D 34/04* (2013.01)

(58) Field of Classification Search
CPC .... A45D 26/00; A45D 26/0004; A45D 27/44; A45D 2026/008
USPC ..... 606/131, 133
See application file for complete search history.

(56) References Cited

U.S. PATENT DOCUMENTS

| | | | | |
|---|---|---|---|---|
| 2,218,072 A | | 10/1940 | Runnels | |
| 4,288,883 A | * | 9/1981 | Dolinsky | A46B 9/026 15/110 |
| 4,473,944 A | | 10/1984 | Carroll | |
| 4,845,845 A | | 7/1989 | Scott | |

(Continued)

FOREIGN PATENT DOCUMENTS

| | | |
|---|---|---|
| CA | 2198404 | 8/1998 |
| DE | 591 498 | 1/1934 |

(Continued)

OTHER PUBLICATIONS

Annual Report & Accounts 2004, Reckitt Benckiser.*

(Continued)

*Primary Examiner* — Gregory Anderson
*Assistant Examiner* — Sarah Simpson
(74) *Attorney, Agent, or Firm* — Troutman Sanders LLP; Ryan Schneider; Chris Davis

(57) ABSTRACT

A device for removing a composition from the skin, for example a depilatory composition, has a handle (1), which carries a non-shaving head (2) which is moved over the skin to effect removal of the composition. There is a zone of flexure (5) which extends laterally across the head separating it into a front portion (4) and a rear portion (3). There may be additional zones of flexure within the device.

44 Claims, 2 Drawing Sheets

(56) References Cited

U.S. PATENT DOCUMENTS

| | | | | |
|---|---|---|---|---|
| 5,771,591 | A * | 6/1998 | Armbruster et al. | 30/527 |
| 5,779,654 | A | 7/1998 | Foley et al. | |
| 5,802,656 | A * | 9/1998 | Dawson et al. | 15/110 |
| 5,980,541 | A | 11/1999 | Tenzer | |
| 5,984,935 | A | 11/1999 | Welt et al. | |
| 6,015,293 | A | 1/2000 | Rimkus | |
| 6,675,479 | B1 | 1/2004 | Walker, Jr. et al. | |
| 6,691,415 | B2 * | 2/2004 | Quals | 30/32 |
| D508,296 | S | 8/2005 | Dibnah et al. | |
| D511,452 | S | 11/2005 | Dibnah et al. | |
| D512,181 | S | 11/2005 | Dibnah et al. | |
| D515,243 | S | 2/2006 | Dibnah et al. | |
| D525,743 | S | 7/2006 | Dibnah et al. | |
| D525,744 | S | 7/2006 | Dibnah et al. | |
| D527,146 | S | 8/2006 | Dibnah et al. | |
| 2002/0128673 | A1 | 9/2002 | Ripich et al. | |
| 2004/0016126 | A1 | 1/2004 | deBlois et al. | |
| 2005/0039279 | A1 * | 2/2005 | Koeth et al. | 15/167.1 |
| 2007/0215590 | A1 | 9/2007 | Barraclough et al. | |
| 2007/0225733 | A1 | 9/2007 | Barraclough et al. | |
| 2008/0132914 | A1 | 6/2008 | Bossard et al. | |

FOREIGN PATENT DOCUMENTS

| | | | | |
|---|---|---|---|---|
| DE | 203 11 422 | | 11/2003 | |
| FR | 2 568 465 | | 2/1986 | |
| GB | 333028 | | 8/1930 | |
| GB | 2 009 017 | | 6/1979 | |
| GB | 2 364 502 | | 1/2002 | |
| GB | 2 364 502 | A * | 1/2002 | |
| GB | 2 384 704 | | 8/2003 | |
| JP | 5-31129 | | 2/1993 | |
| WO | WO 96/02369 | | 2/1996 | |
| WO | WO 03/064121 | | 8/2003 | |
| WO | WO 2004/014181 | A1 * | 2/2004 | A46B 9/04 |
| WO | WO 2004/107909 | | 12/2004 | |
| WO | WO 2004/107909 | A1 | 12/2004 | |
| WO | WO 2005/096875 | A2 | 10/2005 | |
| WO | WO 2005/096876 | A1 | 10/2005 | |
| WO | WO 2005/096877 | A1 | 10/2005 | |
| WO | WO 2005/096878 | A1 | 10/2005 | |
| WO | WO 2005/096880 | A1 | 10/2005 | |
| WO | WO 2005/096881 | A1 | 10/2005 | |

OTHER PUBLICATIONS

PCT International Preliminary Report on Patentability, PCT/GB2005/001335, dated May 10, 2006.

PCT International Search Report and Written Opinion, PCT/GB2005/001335, dated Aug. 22, 2005.

* cited by examiner

DEVICE AND METHOD

This invention relates to a device for removing a composition from the skin, and to an associated method. The invention relates in particular, but not exclusively, to a device for use in a depilatory method.

Hair removing compositions are widely available. They may be epilatory, and effect hair removal by mechanical action. They may be depilatory, and effect hair removal by causing hair degradation by chemical action.

In the case of depilatory compositions, the user applies these to their skin, leaves them for a pre-determined interval to allow them to work, and then removes them from the skin, usually using an article which is provided. This is typically a cloth, sponge or an elastically flexible plastics sheet. Such a plastics sheet may be formed with a curvature so as to facilitate removal of the composition and the hair entrained within it. However some consumers find such a device messy or difficult to use. Many hold such devices close to their leading edge which contacts the skin and consequently it is difficult for them to keep their hand clear of the composition and hair being removed. Furthermore it can be difficult to reach some areas, such as parts of the backs of legs, using such devices. Another problem with present devices is that the user may apply excessive pressure to the skin leading to grazing or chafing, particularly where the skin is folded, wrinkled or loose. Another problem that the devices have no provision for indicating that excessive pressure is being applied.

The present invention relates to a different type of device for the removal of compositions from the skin, including depilatory compositions, efficiently and cleanly preferably with reduced risk of skin damage.

In accordance with a first aspect of the present invention there is provided a device for removing a composition from the skin, the device comprising:

a non-shaving head which in use is moved over the skin to effect removal of the composition;

and a handle;

wherein there is a zone of flexure which extends laterally across the head separating it into a front portion and a rear portion.

A preferred device is designed for use in hair removal, to be drawn over skin to which a depilatory composition has been applied in order to remove, after any required interval, hair and the depilatory composition. Whilst the device may effect the breaking of some hairs which have been weakened by the depilatory composition it cannot be used as a shaving device. Accordingly it does not have a cutting blade and so it is a non-shaving device.

Thus the device preferably has a stick-like or wand-like or rod-like handle, preferably in the form of an elongate shaft adapted to be grasped in one hand, and a wider head. The handle may be straight but is preferably curved. Preferably the maximum width of the head is at least 50% greater than the maximum width of the handle, preferably at least 80% greater, more preferably 150% greater.

Preferably the maximum length of the handle exceeds the maximum length of the head, preferably by a factor of at least 3, more preferably by a factor of at least 5. The head will often be quite squat. Nevertheless it will be appreciated that what is meant by "length of the head" is its dimension in the same sense as the length of the handle.

In this specification when we use terms such as "downward" and "underside" we are referring to the side of the device which faces the skin, in use. Terms such as "upwardly" and "upper" denote the opposite direction. The distal end of the head is regarded as the front of the device and the tip of the handle as the rear of the device.

In this specification the term "zone of flexure" denotes a zone which includes an axis about which one portion of the head may articulate relative to the other, when in use. When the handle is in the form of a straight or curved elongate shaft, the axis of articulation is preferably substantially orthogonal to the length of the shaft.

In addition to having a zone of flexure (or zones of flexure; see later) the device as a whole may have some general flexibility. This general flexibility does not constitute a "zone of flexure" within the meaning of this specification because there is no articulation of one portion relative to another.

Preferably any such general flexibility is slight. Preferably the device as a whole, absent the zone(s) of flexure, may be said to be rigid, or to have only a slight degree of general flexibility.

The front portion of the head may have a leading edge which is substantially straight, at the distal end of the device. The leading edge may make contact with the skin in order to effect removal of the composition. Preferably the leading edge is substantially parallel to the axis about which articulation occurs. Thus in use, flexure about this axis prevents too much pressure from being applied to the skin by the leading edge. The leading edge may be of the same material as the rest of the front portion. Preferably, the leading edge is angular. However, preferably it is not sharp, to the extent that it might effect cutting, either of skin or hair. Thus, by eye when viewed in magnification it can be seen to be radiused.

Preferably the front portion of the head has at least one fin. More preferably, it has at least two fins.

In one embodiment, there may be one or more elastomeric fins along the leading edge; for example projecting from it or covering it. Preferably the or each fin is generally parallel to the axis of articulation within the zone of flexure.

Said one or more fins may be straight; but need not be straight. Indeed, preferably said one or more fins is curved. A preferred curvature is an arc, whose concave side preferably faces towards the handle of the device.

Preferably said one or more fin(s) extends from one side of the head to the other.

Preferably there are at least two fins. Preferably they are parallel. The distance between the free edges of at least two adjacent fins may be less than 3 mm. The distance between the free edges of two adjacent fins may be more than 0.5 mm. The length of a fin, from the underside of the head to the free edge of the fin, may be between 1 and 5 mm and is preferably between about 2 and 4 mm.

At least one fin may be of such a material and/or shape that it effects a more vigorous scraping action than another fin. For example one fin may be of higher modulus than another fin. For example one fin may be of a plastics material and the other fin may be of an elastomeric material. Preferably the plastics material is stiffer and has a more vigorous scraping action, than the elastomeric material.

At least one fin may be of different width to another fin. In such embodiments, suitably the leading fin is wider than the neighbouring fin. Further fins may be progressively narrower.

At least one of the fins may be straight.

At least one of the fins may be non-straight.

At least one of the fins may be curved or wavy. A preferred curvature being an arc, whose concave side preferably faces towards the handle of the device.

At least one of the fins may be wavy. For example it may be of a repeating sigmoidal or zig-zag shape.

At least one and preferably two or more fins have a skin-facing surface leading to a free edge of the fin that, in use, is arranged to be at an angle (when relaxed) of 90° to the skin with respect to the intended direction of movement of the device to effect removal of the composition. The angle of at least one fin may be in the region of less than 70° when relaxed, preferably less than 60°. In use, the angle of at least one fin may be reduced. The angle may be reduced as a result of flexure of the fin on encountering a resisting surface, the skin. The angle may be reduced in normal use by at least 10°, preferably by at least 20°. This is preferred for users with sensitive skin.

For most users, it is preferred that the fins are substantially perpendicular to the under-surface of the head.

Preferably the fins are angular and resilient, not sharp or hard, to the extent that they might effect cutting of undegraded hair. Thus, by eye when viewed in magnification, in side sectional view or side elevation, their tips can be seen to be radiused, in preferred embodiments. Preferably the radius of their tips is at least 0.25 mm, more preferably at least 0.5 mm, and most preferably at least 0.65 mm. Preferably the radius of their tips is up to 1.5 mm, more preferably up to 1 mm, and most preferably up to 0.85 mm. It may be a compound radius, for example having a major radius in accordance with the definitions given above and a minor radius, smaller than the major radius, at the tips. Preferably such a minor radius is up to 0.5 mm, more preferably up to 0.3 mm, most preferably less than 0.25 mm. Preferably it is at least 0.1 mm, more preferably at least 0.15 mm.

At least one fin may have a different profile at its free edge from the profile of the free edge of another fin. At least two fins may have different profiles, for example curvatures, at their free edges. At least three fins may have different profiles, for example curvatures, at their free edges.

Preferably the fins are parallel to each other, and are closely spaced. When there are three or more fins the spacing between adjacent fins is preferably substantially the same.

Fins may be transversely spaced apart. Transversely spaced fins are preferably not laterally spaced apart. Suitably one such fin lies alongside an adjoining fin. Such fins are preferably wide, and may extend from one side of the head to the other. Preferably they are at least 20 mm in width, more preferably at least 30 mm in width.

Devices which have transversely spaced fins may have up to 6 fins. One preferred embodiment of such a device has four fins only. Another preferred embodiment of such a device has three fins only. An especially preferred embodiment of such a device has two fins only.

In another arrangement fins may be laterally spaced apart. Laterally spaced fins are preferably not transversely spaced apart. Suitably laterally spaced fins form a row, with a space between them. Such fins are preferably short. Preferably they do not exceed 10 mm in width. The arrangement of fins is such that a group of them is preferably collectively arranged to traverse across skin in use, without leaving areas of skin which have not been traversed. In such embodiments there may be at least two rows of fins, with the fins of one row being aligned with the spaces between the fins of another row. There may suitably be a third row which, likewise, is aligned with the spaces between the fins of the adjoining row. There could be a fourth such row, or further rows. When there are laterally spaced fins arranged in rows, preferably there are at least two rows. Alternatively small fins is need not be arranged in a row or rows, but could be spaced both laterally and transversely, such that a traverse of the head across the skin removes an unbroken band of composition.

Devices which have laterally spaced fins may suitably have at least 5 fins, preferably at least 8 fins, most preferably at least 12 fins. Such devices may suitably have up to 50 fins, preferably up to 30 fins. Suitably such fins are arranged in at least 2 rows, preferably at least 3 rows. Suitably such fins are arranged in up to 6 rows, preferably up to 4 rows. Preferably such fins within adjacent rows are staggered from each other, as described above.

The head may include a source of a non-depilatory composition arranged to be applied to the skin when the head is moved over the skin. The non-depilatory composition may, for example, be a moisturiser, a fragrance, an oil (which could be a moisturising and/or fragrancing and/or aromatherapy oil), a colorant (such as a chemical "tanning" product), a soap, an exfoliating agent, a sunscreen, an after-sun agent, a deodorant, a lubricant and an insect repellent. The non-depilatory composition could solid, including a gel. The solid may wear down as it deposits on the skin or may leach a composition onto the skin. The non-depilatory composition may be applied upstream of the fins or downstream of the fins or, from between fins. Preferably, it is applied downstream of the fins. The source of a non-depilatory composition may, for example, comprise a compressible or resilient part such as a fabric ply, felt pad or sponge, may be a film-forming mechanical device, for example a roller, or one of more small recesses, for example in the form of grooves or wells, into which the composition was deposited in manufacture, and from which it is drawn, when rubbed over the skin.

The head, or a part of the head which has the fins, may be removable from the rest of the device. Preferably a removed head or head part, or a replacement head or head part, may be bought into engagement with the rest of the device, for continued use.

When the head is removed "the rest of the device" is the handle. When said head part is removed "the rest of the device" is the handle and the rest of the head.

Securement of the head or head part to the rest of the device may be such that the head or head part may be grasped by the user in order to release it. For example the head or head part, when removable in its entirety, may be a force fit on the rest of the device; or may be latched onto the rest of the device (as by, for example, opposite-facing ramps which slide over each other to interengage), the arrangement being such that they are disengagable merely by manipulation. The head or head part, when it is removable, may be pushed or slid into place, on the rest of the device. It may be joined to it by a releasable hinge.

In an alternative embodiment the device may be provided with an actuator which the user may operate to release the head or head part from the rest of the device. The actuator may, for example, be a button provided on the handle or head, which button may be depressed or slid to bring about the release. When that release has been brought about, the head or head part may remain in its same place on the device, but the user can now remove the head or head part from the rest of the device without encountering any resistance. Alternatively when the actuator is operated the head or head part may be displaced from the rest of the device. That is, the act of operating the actuator may cause the interengaged parts to become spaced apart. Such displacement may be assisted by the relaxation or partial relaxation of a resilient part. That resilient part is preferably designed such that when the head is on the handle or the head part is on the rest of the head, the resilient part is stressed. Preferably the act of engaging the head or head part on the rest of the handle stresses the resilient part.

In such embodiments first and second heads or head parts may be provided, which differ from each other. They may differ from each other in any of a large number of ways, some of which are set out below.

The first and second heads or head parts may have respective skin-contacting parts which differ from each other. The first head or head part has a skin-contacting part which has a removal edge. The second head or head part need not have a removal edge. When it does have one, it is preferably a different removal edge, for example being of different overall shape, different tip profile, different thickness, different material, different hardness, different flexibility, or different width (so that a user could use a wide head or head part when effecting depilation of an area such as the calf, and use a head or head part of narrower width when effecting depilation of an area such the ankle, or shin). Whether it has a removal edge or not, the second head or head part may provide a non-depilatory personal aesthetic effect. For example the head or head part may release a non-depilatory composition, suitably as defined above, onto the skin, for example as a post-depilation skin treatment. It should be noted that it is not excluded that the first head or head part could provide any such benefit. At least one of the head or head parts may produce a personal aesthetics effect, for example the release onto the skin of a cosmetic or fragrancing agent, while the other head or head part either does not, or produces a different personal aesthetics effect. In one example one head or head part may release a moisturiser onto the skin, and the other head or head part may release a fragrance onto the skin. However it is preferred that the first head effects removal of the depilatory composition and removed hair and the second head or head part provides a personal aesthetics effect. In other embodiments a second head or head part neither removes a composition from or applies a composition to the skin; but is a skin-contacting part which massages or exfoliates the skin. Of course, one head or head part could fulfil one or more of these functions noted above.

Preferably the head is firmly carried by the handle, even if it is a head which is removable; in the absence of a force or when merely touched there is no tendency for it to be deflected. In use when bearing upon the skin it may articulate against a resistance force.

In a preferred embodiment, hair removal is effected by one or more fins which project(s) transversely from the lower surface of the front portion of the head. Preferably said one or more fins is spaced from the distal edge of the head, and preferably projects transversely from an intermediate region of the front portion, spaced from its front edge and from its rear edge.

In this embodiment the distal edge of the front portion is not a skin-contacting part. It need not be straight. For example it may be curved. Preferably the or each fin is constructed of an elastomeric material. Thus the or each fin is preferably flexible. Preferably the or each fin is sufficiently flexible as to be deflected, in normal use, in a direction opposite to the direction of travel of the device over the skin. Preferably such deflection is sufficient to cause the trailing side of the or each fin to contact the skin, in normal use. When this happens the area of contact between the or each fin is increased, and (for a given force) the pressure applied to the skin is reduced. Such a feature is desirable in order that the device may be comfortable to use: the fins may follow the contour of the skin, and the skin is subject to a less pronounced scraping action. The flexibility of the or each fin is additional to the zone of flexure which is an essential feature of the invention.

In one aspect of the invention, the underside of the head, when at rest with no external force applied, is substantially flat.

In another aspect, the head is domed. Preferably it is curved when viewed from the side. Preferably it is also curved when viewed from the distal end. Preferably, the zone of flexure and the front and rear portions of the head, define, when the device is not in use, a common continuous surface. Preferably it is downwardly concave.

Preferably the device as a whole is arched, preferably being downwardly concave, with the curvature of the head preferably leading smoothly into the curvature of the handle.

In the absence of a force or when merely touched there is no tendency for any deflection or articulation of the device. In use when bearing upon the skin articulation against a resistance force occurs about the zone of flexure.

The zone of flexure need not be an obvious junction. It is suitably a zone which flexes more under a given force than the portions either side of it. Preferably the zone of flexure comprises a different material to the first and second portions. Preferably the zone of flexure comprises an elastomeric material. Preferably the first and second portions are of a stiffer material, preferably a non-elastomeric material, for example a plastics material.

The first and second portions may be connected together by at least one web of their own material. Accordingly in a preferred embodiment the zone of flexure within the head comprises such web(s), and an elastomeric material. In another embodiment the front and rear portions are connected together only by elastomeric material.

In a preferred embodiment the zone of flexure is located approximately one-third to one-half of the distance from the front of the head to the point where it (the head) joins the handle. In use, it may suitably articulate through an angle of at least 5°, preferably at least 10°, and more preferably at least 30°. Yet more preferably it may articulate through an angle of at least 45°, and most preferably at least 60°. In use it may suitably articulate through an angle of up to 170°, more preferably up to 140°, and most preferably up to 120°.

The articulation of the front portion relative to the rear portion of the head may be progressive; from zero deflection when no force is applied, up to its maximum deflection, produced by the maximum force which is applied in normal use.

In another, preferred embodiment the articulation of the front portion relative to the rear portion is non-progressive. Thus, at a certain threshold level of force the front portion is deflected sharply, into a new position. In other words the front portion "flips" into a new position. Preferably the deflection of the front portion is progressive, up to the threshold level of force. At the threshold force the front portion "flips". Preferably the front portion does not undergo any substantial further deflection, beyond its "flipped" position. Any further increase in force is preferably accommodated by increased deflection of the or each fin, which is preferably present in such an embodiment. Preferably during the progressive deflection of the front portion up to its "flip" the distal edge of the or each fin is in contact with the skin, and the trailing side of the or each fin substantially is not; but after the front portion has "flipped" the trailing side of the or each fin is in contact with the skin, and the distal edge substantially is not.

In a preferred embodiment of the present invention in which the front portion of the head "flips" into a new position on application of a threshold force, the device may be designed so that the threshold force represents the highest force which the device is intended to apply to the skin. Once the front portion has "flipped" the user may reduce the force or remove the device from the skin. The front portion suitably recovers its initial position and the removal operation can be continued. In the first such embodiment the "flip" feature is designed as a safety trip mechanism.

In another embodiment the device may be designed such that the removal operation continues once the front portion has "flipped". In this embodiment the "flip" marks the change from a first removal mode to a second removal mode.

In a preferred embodiment, the zone of flexure is in the form of a curved strip of elastomeric material, with the axis of articulation forming a chord of the curved strip.

Thus, the provision of a device having a removal head which is bistable in its configuration is a preferred aspect of the present invention.

In another embodiment, the two portions of the head are at an angle to each other in the rest condition, for example an angle in the range 90-160°, and may be arranged so that the front portion bearing the leading edge or fin(s) lies essentially parallel to the skin when in use, and the rear portion of the head is at a complementary angle to the skin (i.e. 90-20°). Again, the two portions are able to articulate relative to each other about the zone of flexure that extends across the width of the head. In this embodiment such articulation is preferably of the progressive type.

There may be at least one further zone of articulation within the device. In one embodiment this can be at the junction between the head and the handle. Alternatively or additionally it can be within the handle; for example being associated with a thinned region of the handle or provided by a region of elastomeric material replacing part of the handle or located between the head and the handle.

There may be three zones of flexure within a device of the invention; each zone of flexure preferably being as described above.

A non-elastomeric plastics material, for example an olefin polymer, is preferably used to form the structure or bulk of the handle and the head. In one embodiment, the handle is connected to the rear portion of the head by a zigzag-shaped web of the plastics material, which may, for example, form an N-shape when viewed from the side. A preferred olefin polymer is polypropylene. An elastomeric material may be used to fill the spaces or nocks of the N-shaped region. As noted above, in one embodiment this junction forms a zone of flexure.

When the device has one or more fins they are (as noted above) preferably of an elastomeric material; preferably the same elastomeric material as is preferably present in the zone of flexure in the head. Preferably a thermoplastic elastomeric material is employed.

In use, the user holds the handle and places the leading edge, or the fin(s), onto the skin, onto which has been applied a treatment composition. Typically the arrangement is such that the head, and the device as a whole, make an acute angle to the skin when the device is in position to be drawn across the skin, in the rearwards direction. The force applied to the skin is provided by the user to the handle, and this is transmitted via the zone(s) of flexure to the fin(s) or leading edge of the head. Preferably articulation occurs about the zone(s) of flexure, so that the usage is still comfortable, and not mechanically aggressive to the skin. The extent of articulation preferably depends on the force applied. Thus the zone(s) of flexure are preferably such that when the fin(s) or leading edge of the head is in contact with skin, a downward force applied to the handle is always delivered to the front portion of the head, whatever position it has moved to; and in each position a resistance force is experienced.

The device could be used in an alternative manner, whereby the user grasps the front end of the handle, where it joins the head between the thumb and forefinger, or the rear portion of the head. When there are two or three zones of flexure, grasping the device thus may cut out one or two zones of flexure, but not the zone of flexure within the head. Hence, when using the device in this manner, only the front portion of the head may articulate relative to the rest of the device. The device may produce a different sensory perception and/or removal action when used in this manner.

An elastomeric material may be used to form other parts of the device not discussed above, for example a grippable surface on the underside of the handle, or for purely aesthetic reasons. Preferably all elastomeric parts are of the same elastomeric material, moulded together. Preferably the elastomeric material and non-elastomeric plastics material are co-moulded to form a unitary device. Although a unitary device is preferred, a device having a removable head is not excluded. Neither is a device which is made from a single material excluded, in which the zone(s) of flexure are incorporated by the shaping of the device.

Preferably the device has a mass of less than 20 g, and more preferably has a mass of less than 12 g.

Preferably the handle is of a waisted shape, having a widened distal region and a widened proximal region (adjacent the head), with the waist in between. Preferably the distal region has a depression to aid holding. Preferably the proximal end region of the handle is shaped at the sides to form a second holding position which allows the zone of flexure at the front of the handle to be bypassed. Alternatively, a textured surface is moulded in at that location, to provide a comfortable grip.

The device may, in principle, be used to remove any composition from the skin, for example a cleansing or moisturising body pack. However it will be evident from the foregoing that the primary interest is in relation to the removal of a depilatory composition, along with entrained hair. This gives an aspect of the invention which is the use of the devices described above for the removal from skin of compositions which have been used to depilate the skin.

In accordance with a second aspect of the present invention there is provided a device for removing a composition from the skin, the device comprising:

a non-shaving head which in use is moved over the skin to effect removal of the composition;

and a handle;

wherein there are at least two zones of flexure within the device.

Preferably one zone of flexure extends laterally across the head from one side to the other, separating the head into front and rear portions. Preferably features of the zone of flexure are as described and defined above in relation to the first aspect.

One zone of flexure may be located in the region where the handle is joined to the head and may be as defined above in relation to the first aspect.

One zone of flexure may be located within the handle, suitably at a point of decreased thickness and may be as defined above in relation to the first aspect.

A device of the second aspect may be as defined above in relation to the first aspect, except that it could have no zone of flexure within the head, but two zones of flexure elsewhere.

In accordance with a third aspect of the present invention there is provided a method of removing a composition from the skin, in particular a depilatory composition containing hair, by use of a device of the first or second aspect. Such a method, when used to effect depilation, may comprise the steps of:

applying a depilatory composition to the skin;

allowing it to remain on the skin for a pre-determined interval;

removing the depilatory composition and depilated hair by moving a device as defined in the first or second aspect over the skin; and preferably rinsing the skin.

Preferably such a depilation method is one in which, in addition to the depilatory action of the depilatory composition, there is an additional hair removing action of an epilatory nature, achieved by the device. The device is preferably not epilatory in its action in the absence of a depilatory composition; but preferably it is epilatory in its action in conjunction with a depilatory composition, to the extent that hairs weakened by the depilatory composition may be removed by the device. This is potentially very useful because it means that the depilatory composition need only be left on the skin for a reduced period—for example 3 minutes. A longer period would usually be required if the depilatory composition was required to remove all of the treated hair growth, but this would carry with it an increased risk of causing skin irritation. In accordance with the present invention a shorter period can be used in the knowledge that the device can complete the task.

The depilatory composition described herein may for example be a cream, lotion, gel or foam.

The device could be sold on its own. Preferably, however, it is sold in a pack with a receptacle of the composition which is to be applied to the skin. The receptacle may for example be a jar or tube; a conventional aerosol canister; or a multi- or bi-compartment aerosol product (in which the composition and a compressed gas are segregated, inside the canister, the compressed gas driving out the composition when a valve is operated). In the case of a depilatory composition the latter is a preferred way of supplying the composition.

A pack of a composition to be applied to the skin and a device of the first or second aspect could be a carton with the two components in, or it could be a clear plastics package encompassing them (for example a blister pack, or shrink sleeve). Alternatively the device of the first or second aspect could be engaged directly with the receptacle which contains the composition. For example a canister could have a modified cap to which the device is secured.

In accordance with a fourth aspect there is provided a pack comprising a device as defined above and a source of a composition, preferably a depilatory composition.

The invention will now be further described, by way of example, with reference to the accompanying drawings, in which.

Figure 1:
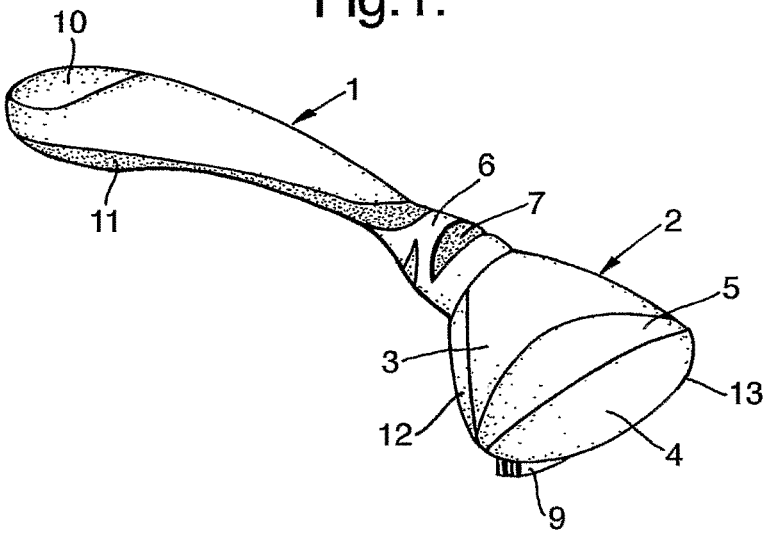
FIG. 1 shows a perspective view from above of a device in accordance with a first embodiment of the invention.
Figure 2:
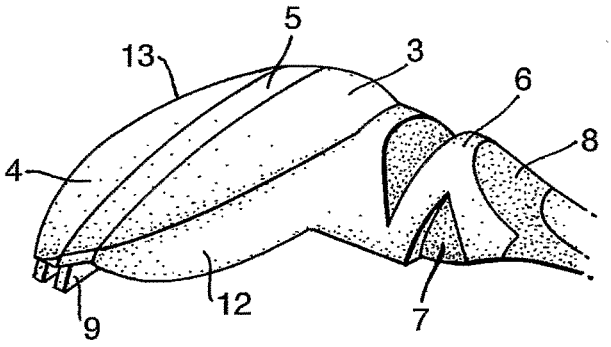
FIG. 2 shows the head and front part of the handle of the device of FIG. 1, in an alternative perspective view from above.
Figure 3:
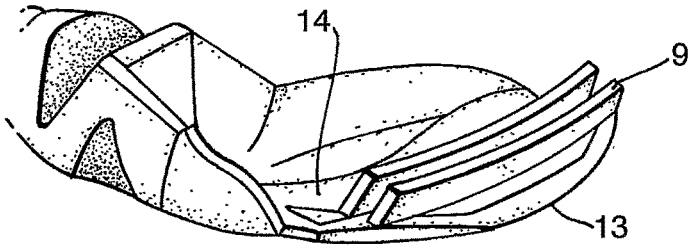
FIG. 3 shows a perspective view of the underside of the head of the device of FIG. 1.

FIGS. 1, 2 and 3 show a depilatory device having a handle 1 connected to a head 2. The head 2 consists of a front portion 4 and rear portion 3 connected to each other by a zone of flexure 5. The front portion carries two fins 9. The front and rear portions of the head 3, 4 and the zone of flexure 5 all form part of the same slightly domed continuous surface when the device is not in use.

Figure 4:
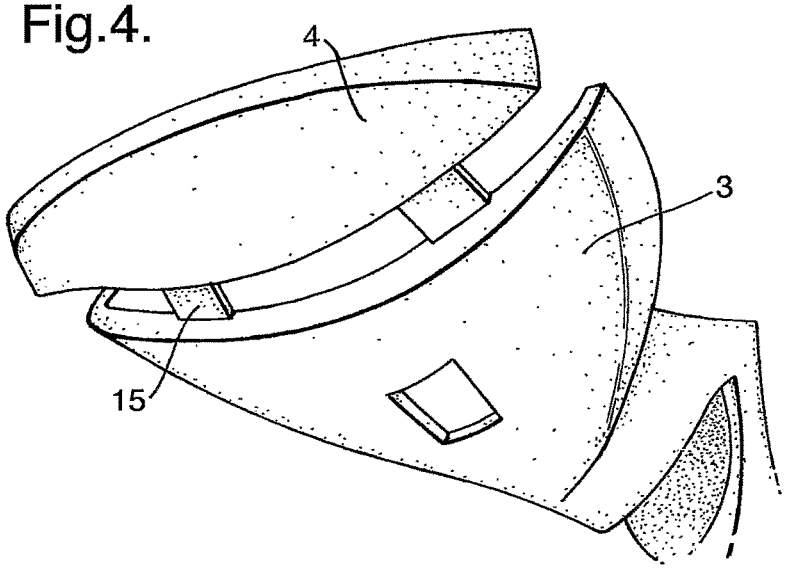
FIG. 4 shows only the polypropylene portion of the head of the device of FIG. 1.

The device is a comoulding of polypropylene, as a generally rigid plastics material, and a thermoplastic elastomeric material. The upper surface of handle 1 and the head portions 3 and 4 are made from a single moulding of polypropylene, as shown in FIG. 4. Rear head portion 3 and handle 1 are connected by a zigzag-shaped section of polypropylene 6 which forms an N-shape when viewed from the side. Rear head portion 3 is joined to front portion 4 by two thin webs of polypropylene 15. These exist so that the device may be cast in a single moulding operation, as well as conferring greater stability to the junction.

The remainder of the device is made from an elastomeric material. The elastomeric material is present in the zone of flexure 5, in the underside 11 of the handle, in an upwardly facing depression 10 located at the distal tip of the handle, for gripping, in fins 9 and in wedges or nocks 7 within the N-shaped junction. All of these sections are connected and are moulded together.

The fins are parallel to each other, and are spaced apart by a small gap. They are slightly curved, rearwardly. That is, they have a slightly concave side which faces the handle. They are approximately parallel to front edge 13, and are approximately 40 mm long and thus extend across most of the width of the head. They are 1 mm wide, 3 mm tall and separated by a space of 2 mm. The distal edges of the fins are tapered.

The device as a whole when viewed from the side is downwardly concave or arched, with a continuous curvature from the handle to the head. The handle is approximately 10 cm long, and the head approximately 3 cm long.

The handle is widest near the rear end (up to 22 mm wide) and tapers to a narrow portion 8 (approximately 9 mm wide) just before the N-shaped junction. The narrow portion of the handle provides a second zone of flexure.

The head of the device is shaped approximately as an isosceles triangle, but having curved edges and corners. At the junction with the handle, the head is approximately 15 mm wide, and at the front edge 13, the width is approximately 45 mm.

The zone of flexure 5 within the head is provided by the mainly elastomeric region. This is generally curved, across the head of the device, and separates it into the front and rear portions. On the lower surface of the head, the elastomeric region forms a thin layer 14 which extends across the centre of rear portion 3 to reach the junction.

The two zones of flexibility described above define axes of flexure which are generally perpendicular to the length of the handle and generally parallel to the fins.

A thin elastomeric layer continues onto the underside of the front portion 4 of the head, from which the two elastomeric fins project transversely.

The head 2 has curved sides 12 around the lower surface. These act as a barrier, holding the removed composition underneath and thus preventing it from coming into contact with the user's hands.

In use, the user holds the device by the handle, typically either grasping it in the palm or fingers, or holding it by finger and thumb using the gripping depression 10. The latter manner may be employed when it is wished to use the device on parts which are awkward to reach, for example the backs of legs. Whatever the manner of holding the device, the fins are placed on the skin, and the device is drawn backwards over the skin; that is, with the head trailing the handle. Force is transferred through the handle via the zone of flexure and junction 6 to the head, in particular to the front portion of the head 4. The two head portions 3 and 4 may articulate relative to each other about zone of flexure 5 so that in use, they no longer form one continuous surface. When viewed from the side, portions 3 and 4 together define an obtuse angle (see FIG. 5).

Alternatively, the user could hold the device between the thumb and forefinger at the sides of the N-shaped junction 6, or by the rear portion of the head, thus bypassing the zone of flexure 8. This may allow closer control of the movement of the device, and/or firmer application of pressure to the skin.

Figure 5:
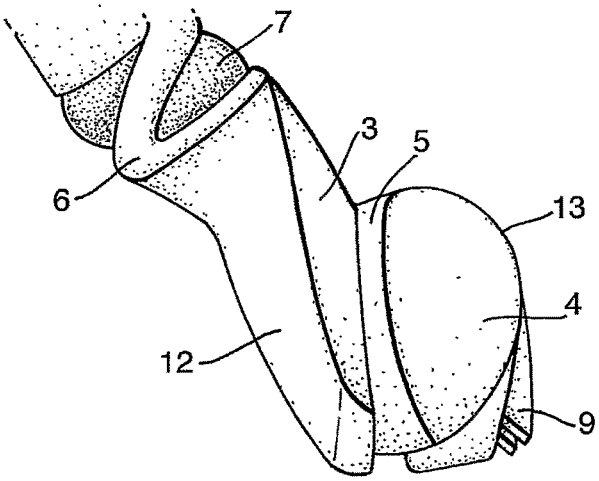
FIG. 5 shows the device of FIG. 1 in use with the front portion of the head articulated relative to the rear portion.

In use the deflection of the device about the zone of flexure defined by narrow portion 8 is progressive; a steadily increasing force causes a steadily increasing deflection. The deflection of the front portion about the zone of flexure 5 with the head is initially progressive. Up to this point the distal edges of the fins have been the main or only parts of the fins in contact with the skin. However at a threshold force the front portion abruptly rocks or flips into a displaced condition, extending upwardly from the rest of the head, as shown in FIG. 5. The trailing side walls of the fins are now the main or only parts of the fins in contact with the skin. Further deflection is substantially inhibited. Instead the application of yet more force is substantially accommodated by further deflection of the fins.

The first embodiment of the invention thus has an in-built safety mechanism minimising the risk of damage to the skin by application of excessive force; at the threshold force the front portion "flips" into its raised position and the contact of the fins with the skin is changed.

The device is sufficiently elastic so that it returns to its original shape when no longer in use.

Figure 6:
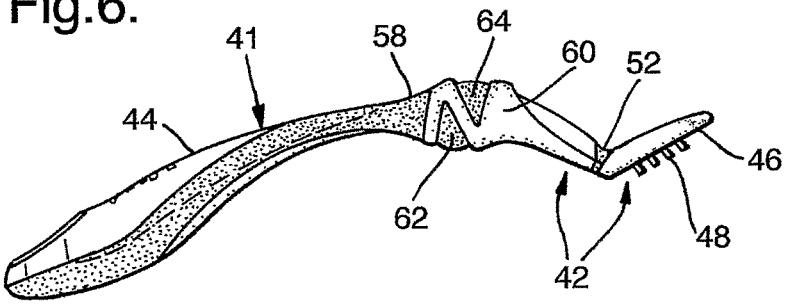
FIG. 6 shows a side view of a second embodiment of the invention.

A second embodiment shown in FIG. 6, also has a handle 41 and a head 42 which is separated into front and rear portions 46 and 60 by a zone of flexure 52. The front portion of the head 46 is tilted relative to the rear portion 60, even when the device is not in use. The front portion is a generally oval-shaped, flat body. It has a planar under-surface which carries four straight, parallel fins 48. It is connected to the rear portion by a wedge 52 of elastomeric material which represents a first zone of flexure of the device. On the handle there is a formation 58 designed for a finger or thumb to rest comfortably against it. Just beyond the formation 58, towards the head, a plastics region is formed in the profile of a letter N. From the right-hand limb of this rear head portion 60 extends up to the elastomeric wedge 52. Within the spaces or nocks defined by the letter N formation there are wedges 62, 64, of elastomeric material. The device thereby has two points of flexure, one being the N-shaped region, and the other being the elastomeric wedge 52.

The invention claimed is:

1. A method of removing a depilatory composition from skin, the method comprising:

providing a device, wherein the device comprises:

a handle;

a non-shaving head, which in use is moved over the skin to effect removal of the depilatory composition, the non-shaving head being coupled to the handle to articulate about the handle through an angle between the non-shaving head and the handle of at least 5 degrees up to 170 degrees; and a zone of flexure comprising a substantially flexible material extending laterally across the non-shaving head, between a front portion and a rear portion of the non-shaving head, the front portion and the rear portion of the non-shaving head comprising a substantially rigid material, the front portion having a surface on a first side of the non-shaving head comprising at least one substantially non-sharp element extending transversely therefrom, the at least one substantially non-sharp element comprising at least two fins extending laterally across the non-shaving head, each fin being formed in the shape of an arc, having a tip at a free edge, and having a concave section of the arc facing the handle, the at least two fins being positioned parallel to one another and closely spaced from one another, wherein the rear portion of the non-shaving head is substantially without a substantially non-sharp element extending transversely from a surface on the first side of the non-shaving head, wherein the handle is an elongate shaft adapted to be grasped by one hand and the zone of flexure is substantially orthogonal to the length of the shaft, wherein an angle between the front portion and the rear portion of the non-shaving head is between 90 degrees and 160 degrees in a rest condition, and when in use the front portion is adapted to lie essentially parallel to the skin and the rear portion is adapted to reside at an angle of 90 degrees to 20 degrees to the skin, and wherein the maximum width of the non-shaving head is at least 150% greater than the maximum width of the handle; and moving the non-shaving head of the device over the skin to remove the depilatory composition from the skin.

2. The method according to claim 1, wherein the zone of flexure of the device is configured to enable an articulation of the front portion relative to the rear portion of the non-shaving head from zero deflection when no force is applied, to progressively increased deflection when a force of less than a predetermined threshold level is applied, and to an abrupt deflection into a displaced position when a force of at least the predetermined threshold level is applied.

3. The method according to claim 1, wherein the zone of flexure of the device comprises an elastomeric material.

4. The method according to claim 1, wherein the front portion and rear portion of the device are of a plastics material and wherein a connection therebetween is within the zone of flexure.

5. The method according to claim 1, wherein an articulation about the zone of flexure of the device is progressive until a threshold value at which there is an abrupt "flip" to a more deflected position.

6. The method according to claim 1, wherein the device further comprises an additional zone of flexure in a region where the handle is joined to the non-shaving head.

7. The method according to claim 1, wherein the device further comprises an additional zone of flexure located at a thinned region of the handle.

8. The method of claim 1, wherein at least one of the at least two fins is fabricated from an elastomeric material.

9. The method of claim 1, wherein the at least two fins extend from the front portion of the non-shaving head.

10. The method of claim 9, wherein the at least two fins are oriented parallel to one another.

11. The method of claim 9, wherein one of the at least two fins is fabricated from a material having a different modulus than a material from which another of the at least two fins is fabricated.

12. The method of claim 9, wherein at least one of the at least two fins are fabricated from an elastomeric material.

13. The method of claim 9, wherein the at least two fins extend laterally across the non-shaving head and wherein one fin of the at least two fins exhibits a width in a direction along a longitudinal axis of the handle greater than an adjacent fin of the at least two fins.

14. The method of claim 1, wherein the at least two fins are formed in a curved configuration.

15. A pack comprising:

a device; and a supply of a depilatory composition to be applied to skin, wherein the device comprises:

a handle;

a non-shaving head, which in use is moved over the skin to effect removal of the depilatory composition, the non-shaving head being coupled to the handle to articulate about the handle through an angle between the non-shaving head and the handle of at least 5 degrees up to 170 degrees; and a zone of flexure comprising a substantially flexible material extending laterally across the non-shaving head, between a front portion and a rear portion of the non-shaving head, the front portion and the rear portion of the non-shaving head comprising a substantially rigid material, the front portion having a surface on a first side of the non-shaving head comprising at least one substantially non-sharp element extending transversely therefrom, the at least one substantially non-sharp element comprising at least two fins extending laterally across the non-shaving head, each fin being formed in the shape of an arc, having a tip at a free edge, and having a concave section of the arc facing the handle, the at least two fins being positioned parallel to one another and closely spaced from one another, wherein the rear portion of the non-shaving head is substantially without a substantially non-sharp element extending transversely from a surface on the first side of the non-shaving head, wherein the handle is an elongate shaft adapted to be grasped by one hand and the zone of flexure is substantially orthogonal to the length of the shaft, wherein an angle between the front portion and the rear portion of the non-shaving head is between 90 degrees and 160 degrees in a rest condition, and when in use the front portion is adapted to lie essentially parallel to the skin and the rear portion is adapted to reside at an angle of 90 degrees to 20 degrees to the skin, and wherein the maximum width of the non-shaving head is at least 150% greater than the maximum width of the handle.

16. The pack according to claim 15, wherein the zone of flexure of the device is configured to enable an articulation of the front portion relative to the rear portion of the non-shaving head from zero deflection when no force is applied, to progressively increased deflection when a force of less than a predetermined threshold level is applied, and to an abrupt deflection into a displaced position when a force of at least the predetermined threshold level is applied.

17. The pack according to claim 15, wherein the zone of flexure of the device comprises an elastomeric material.

18. The pack according to claim 15, wherein the front portion and rear portion of the device are of a plastics material and wherein a connection therebetween is within the zone of flexure.

19. The pack according to claim 15, wherein an articulation about the zone of flexure of the device is progressive until a threshold value at which there is an abrupt "flip" to a more deflected position.

20. The pack according to claim 15, wherein the device further comprises an additional zone of flexure in a region where the handle is joined to the non-shaving head.

21. The pack according to claim 15, wherein the device further comprises an additional zone of flexure located at a thinned region of the handle.

22. The pack of claim 15, wherein at least one of the at least two fins is fabricated from an elastomeric material.

23. The pack of claim 15, wherein the at least two fins extend from the front portion of the non-shaving head.

24. The pack of claim 23, wherein the at least two fins are oriented parallel to one another.

25. The pack of claim 23, wherein one of the at least two fins is fabricated from a material having a different modulus than a material from which another of the at least two fins is fabricated.

26. The pack of claim 23, wherein at least one of the at least two fins is fabricated from an elastomeric material.

27. The pack of claim 23, wherein the at least two fins extend laterally across the non-shaving head and wherein one fin of the at least two fins exhibits a width in a direction along a longitudinal axis of the handle greater than an adjacent fin of the at least two fins.

28. The pack of claim 15, wherein the at least two fins are formed in a curved configuration.

29. A method of effecting depilation, comprising:

applying a depilatory composition to skin;

allowing the depilatory composition to remain on the skin for a pre-determined interval; and removing depilated hair and the depilatory composition by moving the device as defined in claim 15 over the skin.

30. A pack comprising:

a device;

and a supply of a depilatory composition to be applied to skin, wherein the device comprises:

a non-shaving head which in use is moved over the skin to effect removal of the depilatory composition, the non-shaving head comprising at least two fins;

a handle coupled to the non-shaving head, wherein the non-shaving head is articulatable about the handle through an angle of at least 5 degrees up to 170 degrees; and at least two zones of flexure, wherein one zone of flexure of the at least two zones of flexure is made of a different material from the non-shaving head and is configured to enable a portion of the non-shaving head to angularly translate from a position substantially parallel to a longitudinal axis of the handle to a position substantially perpendicular to the longitudinal axis of the handle, wherein the maximum width of the non-shaving head is at least 150% greater than the maximum width of the handle.

31. The pack according to claim 30, wherein one zone of flexure of the at least two zones of flexure of the device is configured to enable an articulation of a front portion of the non-shaving head relative to a rear portion of the non-shaving head from zero deflection when no force is applied, to progressively increased deflection when a force of less than a predetermined threshold level is applied, and to an abrupt deflection into a displaced position when a force of at least the predetermined threshold level is applied.

32. The pack according to claim 30, wherein one zone of flexure of the at least two zones of flexure of the device comprises an elastomeric material.

33. The pack according to claim 30, wherein a front portion of the non-shaving head and a rear portion of the non-shaving head are of a plastics material and wherein a connection therebetween is within one zone of flexure of the at least two zones of flexure.

34. The pack according to claim 30, wherein an articulation about one zone of flexure of the at least two zones of flexure of the device is progressive until a threshold value at which there is an abrupt "flip" to a more deflected position.

35. The pack according to claim 30, wherein the device further comprises an additional zone of flexure in a region where the handle is joined to the non-shaving head.

36. The pack according to claim 30, wherein the device further comprises an additional zone of flexure located at a thinned region of the handle.

37. The pack of claim 30, wherein at least one of the at least two fins is fabricated from an elastomeric material.

38. The pack of claim 30, wherein the at least two fins extend from a front portion of the non-shaving head.

39. The pack of claim 38, wherein the at least two fins are oriented parallel to one another.

40. The pack of claim 38, wherein one of the at least two fins is fabricated from a material having a different modulus than a material from which another of the at least two fins is fabricated.

41. The pack of claim 38, wherein at least one of the at least two fins is fabricated from an elastomeric material.

42. The pack of claim 38, wherein the at least two fins extend laterally across the non-shaving head and wherein one fin of the at least two fins exhibits a width in a direction along the longitudinal axis of the handle greater than an adjacent fin of the at least two fins.

43. The pack of claim 30, wherein the at least two fins are formed in a curved configuration.

44. A method of removing a depilatory composition from skin, the method comprising:

providing the device as defined in claim 30; and moving the non-shaving head of the device over the skin to remove the depilatory composition from the skin.

* * * * *